US006920292B2

(12) United States Patent
Metzler

(10) Patent No.: US 6,920,292 B2
(45) Date of Patent: Jul. 19, 2005

(54) METHOD AND CONTROL DEVICE FOR PREVENTION OF IMAGE PLANE REGISTRATION ERRORS

(75) Inventor: Patrick Metzler, Schlaufenglan (DE)

(73) Assignee: Eastman Kodak Company, Rochester, NY (US)

( * ) Notice: Subject to any disclaimer, the term of this patent is extended or adjusted under 35 U.S.C. 154(b) by 127 days.

(21) Appl. No.: 10/458,600

(22) Filed: Jun. 10, 2003

(65) Prior Publication Data

US 2004/0109714 A1 Jun. 10, 2004

(30) Foreign Application Priority Data

Jun. 21, 2002 (DE) ..... 102 27 766

(51) Int. Cl.[7] ..... G03G 15/04
(52) U.S. Cl. ..... 399/51; 399/394
(58) Field of Search ..... 399/51, 301, 394, 399/396; 347/116; 101/481, 485

(56) References Cited

U.S. PATENT DOCUMENTS

| | | | | | |
|---|---|---|---|---|---|
| 4,660,077 | A | * | 4/1987 | Kawamura et al. | 358/515 |
| 5,444,525 | A | * | 8/1995 | Takahashi et al. | 399/76 |
| 5,983,066 | A | * | 11/1999 | Abe et al. | 399/394 |
| 6,029,572 | A | | 2/2000 | Rodi | 101/215 |
| 6,112,655 | A | | 9/2000 | Suzuki et al. | 101/118 |
| 6,591,747 | B2 | * | 7/2003 | Buch et al. | 101/211 |
| 6,619,209 | B2 | * | 9/2003 | Dreher et al. | 101/485 |

FOREIGN PATENT DOCUMENTS

| | | | | |
|---|---|---|---|---|
| JP | 01273066 | A * | 10/1989 | G03G/15/01 |
| JP | 05094060 | A * | 4/1993 | G03G/15/00 |
| JP | 05193785 | A * | 8/1993 | B65H/7/10 |
| JP | 10010805 | A * | 1/1998 | G03G/15/00 |

OTHER PUBLICATIONS

K.–H. Forster: Bedingungen und Prinzipe der Steuerung von Verarbeitungsmaschinen pp. 58–63.

* cited by examiner

*Primary Examiner*—Robert Beatty
(74) *Attorney, Agent, or Firm*—Lawrence P. Kessler

(57) ABSTRACT

A method and a control device for prevention of registration errors. In the current state of the art, a control circuit of a control device eliminates registration errors. A first sensor detects a sheet before a printing module and a second sensor detects the sheet after the printing module, an actual number of pulses is counted between the detection of the sheet by the first sensor and by the second sensor and this actual number of pulses is fed into a closed-loop control system as an actual parameter, the actual number of pulses is compared with a reference number of pulses, which represents a reference parameter of the closed-loop control system, a control signal of the closed-loop control system is determined from this comparison, and a number of pulses is conducted into a controlled process of the closed-loop control system, which number of pulses is in direct relation to the current sheet to be printed in the printing module.

8 Claims, 4 Drawing Sheets

METHOD AND CONTROL DEVICE FOR PREVENTION OF IMAGE PLANE REGISTRATION ERRORS

FIELD OF THE INVENTION

The present invention relates to a method and control device for preventing image plane registration errors.

BACKGROUND OF THE INVENTION

One of the fundamental functions of printing presses is an accurate, error-free application of images, especially the superimposition of individual single-color images, which then form a composite multi-color image. For this purpose, the so-called color-to-color registration marks are used, which are applied onto the conveyor belt or onto a sheet carried on such conveyor belt. This characteristic feature is called image plane registration. In order to define the image plane registration, special register marks are made outside the printed image, by which the operator of the printing press can determine and measure deviations from properly positioned printing.

In a more advanced version of this procedure the image plane registration is determined and calculated by sensors and computer control located in the printing press. The sensors scan the register marks on the conveyor belt or on the sheet and, using the scanned position of the register marks, the computer control determines whether the printing process occurs error-free with respect to the image plane registration. Any register discrepancy is eliminated by a closed-loop control system.

For this purpose an actual position of the register marks is compared with a reference position and the difference is then used to correct the image plane registration. U.S. Pat. No. 5,893,658 discloses an apparatus for registering multiple image planes of a single image in an electrographic system including an image-printing receptor drum, an image-printing device to create overlaying single-color images on the image-printing receptor drum, at least one developer station, a measuring device for measuring the rotational position of the receptor drum, a drive mechanism for controlling a motor coupled to the receptor drum by at least one drive belt, and a closed-loop positioning system connected with the measuring device and the drive mechanism, whereby the closed-loop positioning system modulates the angular velocity of the receptor drum to guarantee proper image plane registration. Depending on the transit times of the sheets on the conveyor belt, correction parameters to correct any register discrepancy are used for the current sheet to be printed in a printing module, wherein these parameters relate to a sheet that is scanned by a sensor at the end of the conveyor belt. Therefore, the correction of the image plane registration by the correction parameters occurs in relation to an error determined by a sensor at the end of the conveyor belt.

In reality, the size of the register discrepancy changes, for example, by any change in the circumference of the printing drum, and during the time period, in which the sheet is transferred by the conveyor belt from the printing module, in which it has been printed, to the end of the conveyor belt, where it is scanned by a second sensor. Thus, due to the described effect, the determination and elimination of the register discrepancy is not totally accurate. It is desirable to provide a correction parameter in such a manner that such a correction of any register discrepancy can be performed that is related to a sheet located in the nip of the printing module and not to a sheet that is being scanned by a sensor at the end of the conveyor belt.

SUMMARY OF THE INVENTION

The goal of the present invention is to eliminate, with high accuracy, register discrepancy in printing presses. According to this invention, the quality of eliminating register discrepancy is increased. This is achieved by using such correction parameters for the elimination of register discrepancy that relate to the point in time, at which the sheets are being printed on.

A current registration error can be eliminated by way of controlling the point in time, at which the overlaying single-color images are created on the image-printing receptor drum. This feature facilitates the correction of registration errors. This also dispenses with the costly control of the rotational speed of the image-printing receptor drum and the speed of the conveyor belt in order to correct the point in time, at which the image is applied.

The invention, and its objects and advantages, will become more apparent in the detail description of the preferred embodiment presented below.

BRIEF DESCRIPTION OF THE DRAWINGS

The subsequent text describes in detail examples of the invention with reference to FIGS. 1–6. The described embodiments should be understood only as exemplary versions that do not limit the scope of the patent defined by the individual claims. In the detailed description of the preferred embodiment of the invention presented below, reference is made to the accompanying drawings, in which:

DETAILED DESCRIPTION OF THE INVENTION

Figure 1:
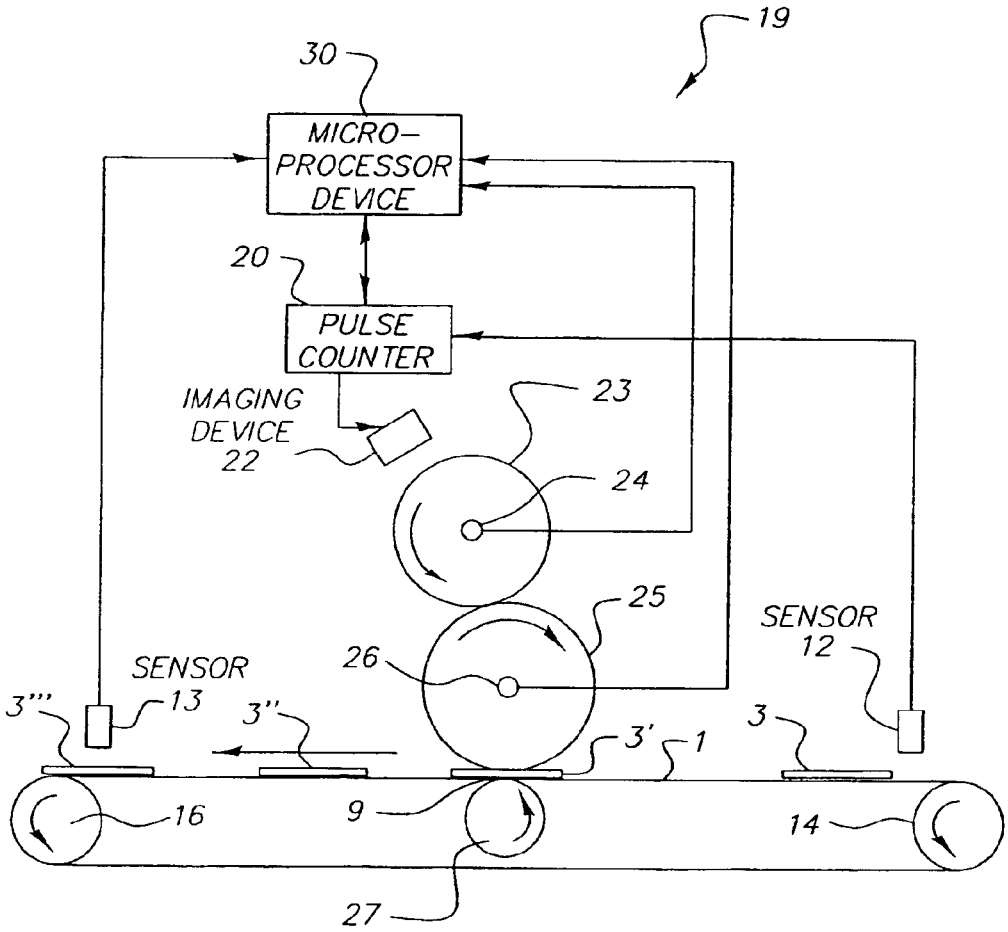
FIG. 1 shows a schematic side view of a printing module with a control device of an embodiment of the invention.

Referring now to the accompanying drawings, FIG. 1 shows a schematic side view of a part of a printing module or printing unit of a multiple-color printing press above a conveyor belt 1. A printing press usually includes several printing modules, i.e., a printing module for each color, wherein, as is well known, the individual colors create together a composite multi-color image on the printing medium. The conveyor belt 1 is driven by a drive mechanism attached to the second return pulley 16 and moves in the direction of the associated arrow. The first return pulley 14, the second return pulley 16, an intermediate drum 25, a receptor drum 23, and a counter-pressure drum 27 providing a force opposite to the printing force of the intermediate drum 25 move in directions, of associated arrows as illustrated in FIG. 1. The term "printing drum" includes the receptor drum 23 and the intermediate drum 25 as intermediate carriers of the image to be printed, depending on the circumstance whether the image is applied by the receptor drum 23 directly onto a sheet 3, or first onto an intermediate drum 25 and this drum then transmits the image on the sheet 3.

The receptor drum 23 and the intermediate drum 25 include a first rotary impulse generator 24 and/or a second rotary impulse generator 26, which detect the rotational angle of the receptor drum 23 and the intermediate drum 25 so that their rotational angle is known at any time. The first rotational impulse generator 24 at the receptor drum 23 and the second rotational impulse generator 26 at the intermediate drum 25 transmit the recorded rotational angle to a micro-processor device 30. The micro-processor device 30 includes reference tables or look-up tables providing a register, which receives data from the first rotational impulse generator 24, the second rotational impulse generator 26, the drive unit at the second return pulley 16 and the second sensor 13 or register sensor and where position pulses are assigned. The position pulses obtained from the look-up tables serve for defining the point in time, at which the application of an image onto the receptor drum 23 starts. In this connection, the term of "image" comprises single-color images of the individual printing modules (which then form a composite multi-color image; for example, cyan, magenta, yellow, and black images in case of four-color printing), individual lines of the image, or image sections. FIG. 1 illustrates only a printing module for one single-color image: cyan, magenta, yellow, or black; additional printing modules can be provided along the conveyor belt 1.

After a certain number of pulses pre-determined by the reference tables or look-up tables of the micro-processor device 30, the pulse counter 20 transmits a signal to an imaging device 22, which based on this signal transmits an electrostatic image onto the receptor drum 23. For this purpose, the receptor drum 23 includes an electrostatically charged photoconductor layer, onto which the imaging device 22 emits controlled light, e.g., from a LED source or a laser. On the spots, where the controlled light hits the electrostatically charged photoconductor layer of the receptor drum 23, the electrostatic charge is eliminated. Subsequently, toner particles with opposite electrical charge are applied to the spots freed from the electrostatic charge so that an image is created on the receptor drum 23. This image is transferred to an intermediate drum 25, which rotates in opposition to the receptor drum 23, and from the intermediate drum 25 the image is printed on the sheet 3.

The intermediate drum 25 exerts a force on the conveyor belt 1 from above a counter-pressure drum 27 exerts an opposite force on the conveyor belt 1 from below. The receptor drum 23, the intermediate drum 25, the first return pulley 14 and the counter-pressure drum 27 are driven by the frictional contact with the conveyor belt 1, which is driven by a drive at the second return pulley 16. The imaging by the imaging device 22, which is triggered by the pulse counter 20 as a consequence of a first signal transmitted by the first sensor 12, occurs exactly at such point in time that the image is transferred from the receptor drum 23 through the intermediate drum 25 onto the sheet 3 with micrometer accuracy.

In a more detailed description, the first sensor 12 at the beginning of the conveyor belt 1 detects the front edge of the sheet 3 and, in response to this, sends a first signal to the pulse counter 20. As a consequence of this first signal, the pulse counter 20 generates a second signal, which triggers the imaging of the receptor drum 23 by an imaging device 22. The second signal is sent exactly at such point in time that the image transmitted onto the receptor drum 23 is printed onto the intermediate drum 25, and then transferred by the intermediate drum 25 exactly to the correct place on the sheet 3, when the sheet 3 is located in the nip 9 between the intermediate drum 25 and the conveyor belt 1. This is made possible by knowing the speed of the conveyor belt 1 with the sheet 3, the distance of the first sensor 12, and the first signal generated by this sensor, from the image transmission place between the intermediate drum 25 and the sheet 3, i.e., the nip 9.

The rotational speed of the receptor drum 23 and the intermediate drum 25 is easily derived, because they are driven by frictional contact with the conveyor belt 1 and their circumference is known. The time required to transport the sheet 3 to the nip 9 after the first signal minus the time required by the image to arrive from the imaging device 22 to the nip 9 approximately equals a delay time from the first signal to the second signal. The second signal triggers the imaging performed by the imaging device 22. In reality, the actual delay time is a little longer, because the first signal is generated upon detection of the front edge of the sheet 3, whereas the image is applied onto the sheet 3 only after the front edge passes. The delay time is assigned a unique number of pulses, which is stored in the reference tables or look-up tables of the micro-processor device 30. The corresponding number of pulses is transmitted by the micro-processor device 30 to the pulse counter 20, and the pulse counter counts it. After the appropriate number of pulses is counted, the pulse counter 20 generates a second signal and triggers the imaging by the imaging device 22.

Figure 2:
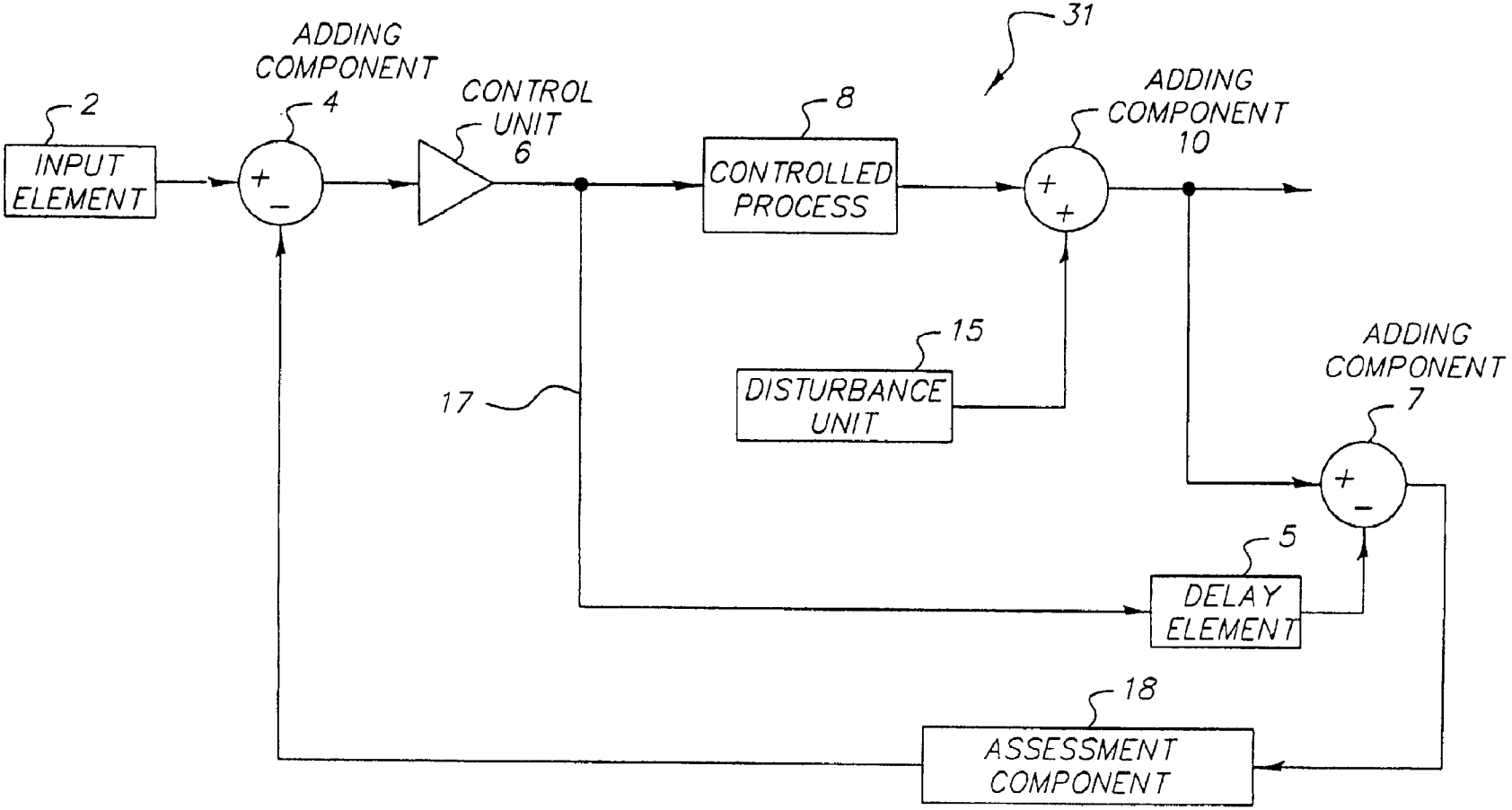
FIG. 2 shows a schematic block diagram of a closed-loop control system, for correcting registration errors to represent the principle of registration error correction.

FIG. 2 shows a schematic block diagram of a closed-loop control system 31 for the correction of registration errors in a device 30 as shown in FIG. 1. In the circuit block of the reference input element 2, a reference value is entered into a first adding component 4; in the present closed-loop control system this reference value is the command variable. In the actual circumstances, the reference value is a reference number of pulses. The reference value corresponds with the reference point in time of the imaging of the receptor drum 23 in the printing module under ideal conditions without any disturbing influences, whereby the imaging is triggered by the second signal generated by the pulse counter 20, and the imaging device 22 applies latent images onto the receptor drum 23 at the reference point in time. However, due to disturbing influences the reference values provided by device 30, as shown in FIG. 1, result in errors in printing, i.e., single-color images and sections of single-color images are printed in shifted positions, that is the individual single-color images are not accurately superimposed.

A signal is transmitted from the circuit block of an assessment component 18 to the first adding component 4 and is subtracted from the reference value or the command variable of the reference input element 2. The assessment component 18 serves for deriving a correction parameter for the correction of a registration error from available correction parameters by various known procedures. In general, the assessment component 18 assesses future parameters on the basis of past parameters. The signal resulting from the addition of the signals of the reference input element 2 and the assessment component 18 is transmitted to a control unit 6, which in this case is a proportional controller.

After this control unit 6, a correcting variable is picked up, which serves as the correction parameter of the control device 19 to correct registration errors. After the control unit 6, the signal branch splits. The first upper signal path leads to controlled process 8, which in the present block diagram of a closed-loop control system 31 corresponds with the conveyor belt 1, and which in the present exemplary digital closed-loop control system performs a Z-transformation. This Z-transformation denotes a delay of the signal for the triggering of the imaging, i.e., of the second signal. So, for example, $1/z^5$ denotes a delay of the signal corresponding to the transport of five sheets 3 from the first sensor 12 to the second sensor 13, especially between the detection of the front edge of the sheet 3 by the first sensor 12 and the detection of a particular line on the same sheet 3 by the second sensor 13, which has been previously applied onto the sheet 3 by the intermediate drum 25. It means that a time delay occurs before the image is transmitted on the current sheet 3 detected by the first sensor 12, wherein in this example five sheets 3', 3", 3'", carried by the conveyor belt 1 before the current sheet 3 detected by the first sensor 12, arrive from the first sensor 12 to the nip 9, which results in exponent five of the delay.

The delay element 5 simulates the time delay of the controlled process 8. In this manner, at the same time as the second sensor 13 detects the sheet 3'", the delay time used for the same sheet 3'" converted into number of pulses is thus immediately available. In the upper first path as shown in FIG. 2 an undesirable disturbance variable is added to the signal in a disturbance unit 15 of a third adding component 10, which signal—if not corrected—results in registration error. In this case, due to the disturbance variable, the imaging occurs at a wrong time. This disturbance variable can be caused by various reasons; for example, when the receptor drum 23 and/or the intermediate drum 25 warm up, their material expands, which results in a change of their circumference. The disturbance unit 15 reflects this fact in the closed-loop control system 31. Changed circumferences of the drums 23, 25 cause changed transmission conditions between the receptor drum 23 and the intermediate drum 25 and, therefore, to transmission errors of the relevant image to be printed on the sheet 3. This effect can be simply explained in such a manner that a change in the circumference of the drums 23, 25 results in a change of their speed on the surface, i.e. enlargement of their circumference causes a delayed application of the image on the sheet 3.

The actual parameter of the closed-loop control system 31 at the output of the third adding component 10 is derived from a signal comprising the disturbance variable. In this example, the actual parameter is an actual number of pulses. A control variable is present at the output of the assessment component 18, which control variable is returned and subtracted in the first adding component 4 from the reference parameter of the reference input element 2. In addition, a signal branch 17 is provided, which leads from the output of the control unit 6 to the delay element 5. The signal is further conducted from the delay element 5 to a second adding component 7, at which it is subtracted from the actual parameter of the closed-loop control system 31. The output signal of the second adding component 7 is fed into the assessment component 18. The signal filtered in the assessment component 18 produces the control variable, which is added in the first adding component 4 to the reference parameter from the reference input element 2.

A parameter, a number of pulses, is fed through the signal branch 17 into the controlled process 8, which parameter is in direct reference to the currently printed sheet 3 in the nip 9 of the printing module. The number of pulses determines a certain point in time for the application of an image by the imaging device 22 without any influence from the previously described control process. The signal at the output of the control unit 6 passes the controlled process 8 through an upper signal branch and reflects no time delay of the conveyor belt 1. The signal at the output of the control unit 6 passes the delay element 5 in a lower signal branch 17 and is delayed in such a manner that it is in direct reference to the sheet 3' to be printed in the relevant printing module. The delay element 5 simulates the time delay.

In this manner, at the same time as the second sensor 13 detects the sheet 3'", the delay time used for the same sheet 3'" converted into number of pulses is thus immediately available. The imaging is performed after the delay time elapses. In contrast to this, the actual parameter in the closed-loop control system 31 at the output of the third adding component 10 without the signal branch 17 relates to a sheet 3'", which has already left the relevant printing module and is detected by the second sensor 13 or register sensor.

In normal operation, there are several sheets 3", 3'" on the conveyor belt 1 between the printing modules and the second sensor 13. The registration error is corrected using a number of pulses in direct reference to the current sheet 3' located in the nip 9. In this manner, the control device 19 according to this invention uses a correction parameter in the form of a number of pulses, which directly relate to the registration error, which is currently present in the nip 9, rather than a correction parameter of the delayed registration error, which exists at the sheet 3'" at the second sensor 13. By this process, the registration error is corrected in a substantially improved manner.

Figure 3:
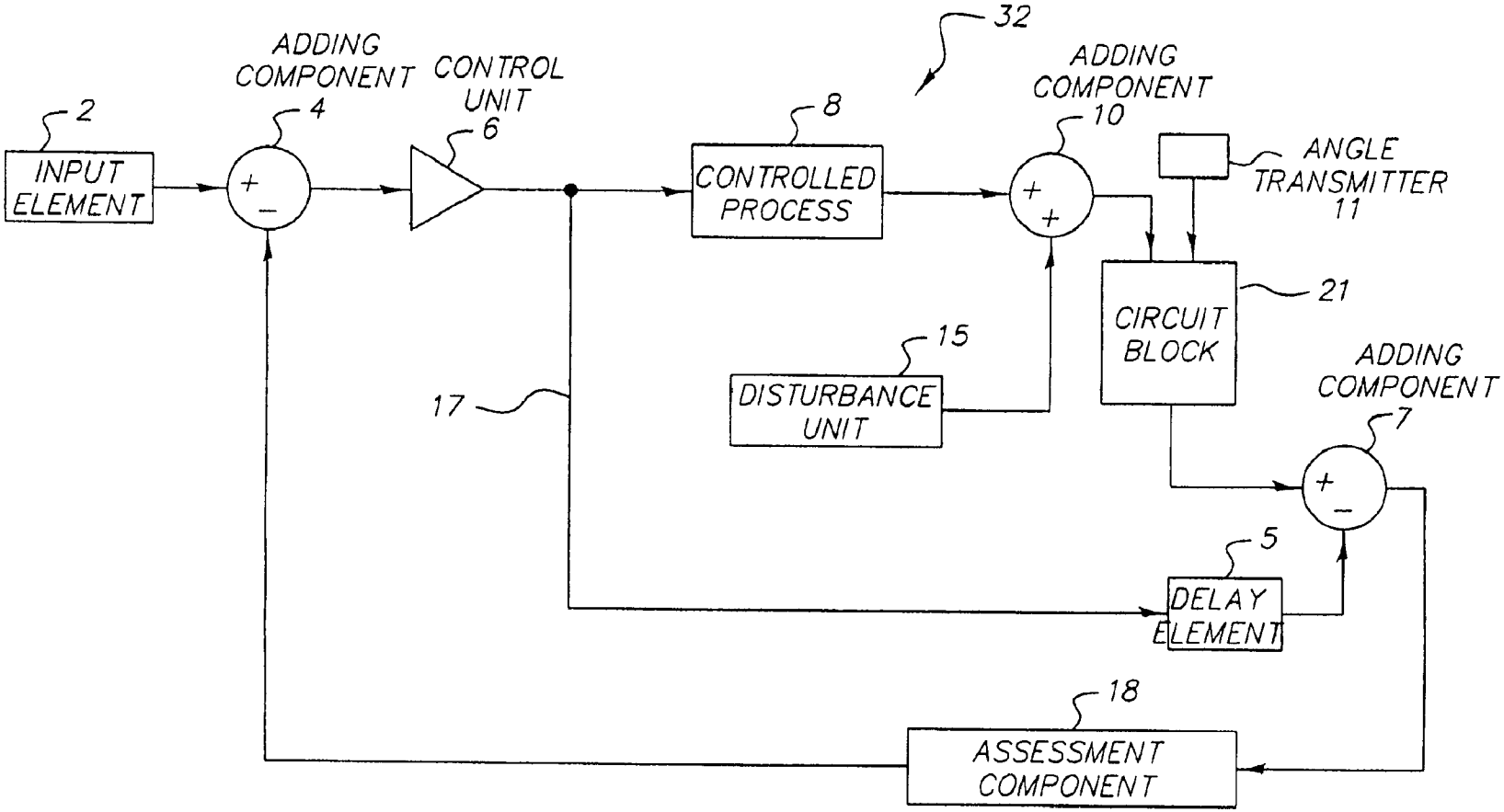
FIG. 3 shows a schematic block diagram of a closed-loop control system for correcting registration errors of another embodiment of the invention.

FIG. 3 shows a schematic block diagram of a variant of the invention similar to that shown in FIG. 2. The reference parameter from the reference input element 2 is added to the control parameter in the first adding element 4. The output signal of the first adding element 4 is fed into the control unit 6. The control unit 6 is a proportional element; however, it can be also designed as a proportional-integral (PI) control unit. Its output signal is led into the upper branch with the controlled process 8. After the controlled process 8, a disturb signal from a disturbance unit 15 is added in the third adding component 10. The disturbance unit 15 simulates disturbances that arise for various reasons and require control of the signals triggering the imaging.

The resulting signal at the output of the third adding component 10 together with the data related to the rotational angle of a printing drum (receptor drum 23 and/or intermediate drum 25), and the output signal of the delay unit 5 are conducted to the second adding component 7. The source of the data related to the rotational angle is denoted by the circuit block of the rotation angle transmitter 11, wherein the data are provided by the rotational impulse generators 24 and 26 as shown in FIG. 1. For this purpose the rotational impulse generators 24 and 26 are connected with the device 30.

The rotation angles are detected and recorded, when the second signal, which is delayed by the first signal from the first sensor 12, triggers the imaging of the receptor drum 23 with a frame. From the difference between the reference parameter and the control parameters in the first adding component 4 follows the point in time, at which the imaging of the receptor drum 23 must be performed in an error-free manner in order to eliminate the effect of disturbing influences. In the circuit block 21, data that trigger the start of the imaging of a frame of a single-color image by the imaging device 22 onto the receptor drum 23 are converted into data that trigger the start of an individual line of a single-color image.

The embodiment according to FIG. 3 therefore controls the imaging of individual lines by the imaging device 22 onto the receptor drum 23. These are the lines that, superimposed in the individual printing modules of multiple-color printing press, create a composite multi-color image and that are transmitted by the relevant imaging device 22 in the individual printing modules crossways to the direction of rolling onto the receptor drum 23 and by the receptor drum 23 through the intermediate drum 25 crossways to the direction of rolling onto the sheet 3. The intermediate drum 25 applies the individual lines in a predetermined order and crossways to the direction of motion of the sheet 3. In the second adding component 7, data of the delay element 5 and the circuit block 21 are added. The delay element 5 obtains data from the control unit 6, which can be designed, for example, as a proportional controller. The delay element 5 contains the same delay as the controlled process 8, i.e., $1/z^5$.

The circuit block 21 receives data that are related to a rotational angle of a printing drum of the printing press, wherein the printing drum is the receptor drum 23 or the intermediate drum 25. The rotational angles of both drums can be used. From this it follows that the control parameter at the output of the assessment component 18 after the second adding component 7 directly relates to the rotational angle of the printing drums 23, 25. Furthermore, the circuit block 21 receives data from the third adding component 10. The reference input element 2 releases data that are independent from undesired influences such as warming up of the receptor drum 23 and/or the intermediate drum 25 and that are added to the control parameter. The data filtered by the assessment component 18 represent the control parameter, which corrects the reference parameter data of the reference input element 2 and essentially eliminates any undesired influences.

At the output of the first adding component 4 is present a controlled variable of the closed-loop control system 32. In the device 30 as shown in FIG. 1, this controlled variable is assigned a certain number of pulses, which is then transmitted to pulse counter 20. Therefore, in the embodiment as shown in FIG. 3 the imaging of the receptor drum 23 is performed with the controlled data of the closed-loop control system 32, which are directly related to the rotational angles of one or several printing drums per each printing module. In a preferred embodiment of the invention the data are in direct relation to the rotational angle of the receptor drum 23, however not in direct relation to the rotational angle of the intermediate drum 25. The previously described correction of registration errors by the control device 19 is performed during the printing process. Any disturbing influences, which usually occur only after a certain time of the printing press operation, are therefore avoided during the printing process. These disturbing influences cannot usually be eliminated in the calibration runs, because they occur only after certain duration of the printing press operation and the corresponding warm-up processes.

Figure 4:
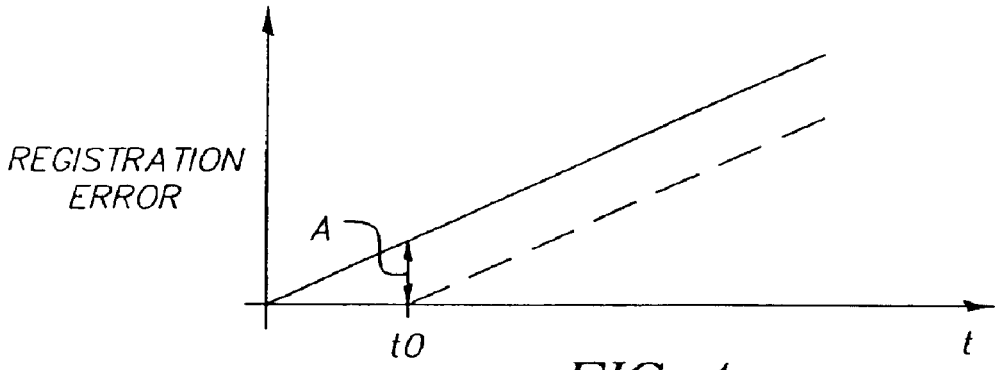
FIG. 4 shows a diagram of a registration error as a function of time without any control device.
Figure 6:
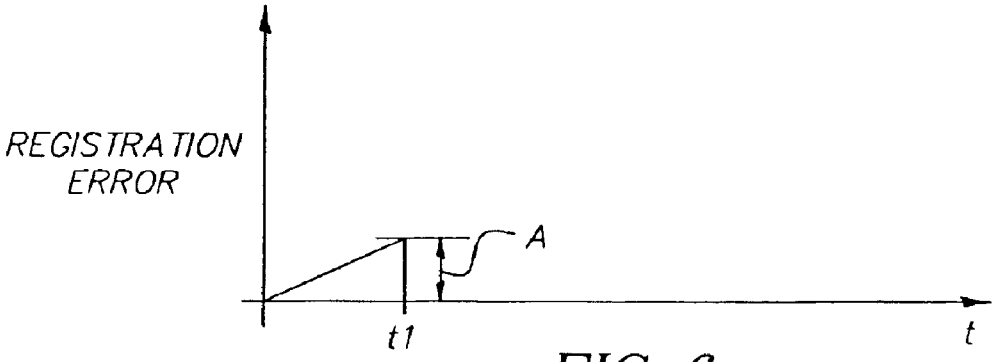
FIG. 6 shows a diagram of a register discrepancy with the use of a control device according to yet another embodiment of the invention.

FIG. 4 shows a diagram with a qualitative registration error without the use of a control device 19, when the length is represented as a function of time t. While the curve trace of the registration error is represented as a straight line, the actual curve trace oscillates along the represented straight line. The registration error as shown in FIG. 6 drifts to progressively higher values. The registration error is caused by thermal changes in the receptor drum 23 and the intermediate drum 25, whose interference changes in the course of time, due to which circumstances, images are applied onto the sheet 3 at a wrong time. The full line represents a registration error without any correction by a control device 19 as a function of time t. The intermittent line underneath the full line represents the registration error as a function of time t measured by the second sensor 13 without any correction by a control device 19.

The full line represents the registration error without any correction by a control device 19, which must be corrected in order to obtain an improved registration error correction. The intermittent line runs parallel to the full line with a temporal shift. This means that the second sensor 13 detects the registration error with a delay in time. The intermittent line represents the registration error that is detected by the second sensor 13. This delay t0 corresponds with the time delay by the controlled process 8, which the sheet 3 requires to be transported over the conveyor belt 1. The approximately constant difference of the registration error between the full line and the intermittent line is designated with A, i.e., in the previous state of the art the correction was performed with an error A, because in the previous state of the art it was not the correction parameters related to the current registration error but rather the correction parameters related to the delayed registration error and detected by the second sensor 13 that were used for any correction.

Using FIG. 4 the previously described issues are made clear, i.e., depending on the run time of the sheet 3 on the conveyor belt 1, the control parameters used to correct registration errors regarding a sheet 3' currently located in the printing module are directly related to a sheet 3''', which is only detected and recorded by a second sensor 13 at the end of the conveyor belt 1. As shown in FIGS. 2 and 3, the correction of the registration error by the number of pulses from the pulse counter 20 directly relates to a situation existing during the actual printing on the sheet 3' and not to a situation existing at the sheet 3''' when detected by the second sensor 13. This is ensured by the assessment component 18, which assesses the drifting of the curve of the registration error using known curve parameters.

The assessment performed by the assessment component 18 is a calculation process, during which, for example, based on the known linear curve trace of the registration error a future curve trace is assumed, from which the correction parameter of the device 30 is then derived. The correction parameter obtained from the assessment component 18 is converted into a number of pulses by the device 30, with which the registration error is then corrected as previously described. The assessment component 18 generates correction parameters that are related to the sheets 3, 3', 3'' to be detected by the second sensor 13 in the future. In the illustrated example, it is the current sheet 3', whose registration error is calculated using the registration errors of the preceding sheet 3''' and subsequent sheets that have already been detected and recorded by the second sensor 13. Subsequently, the registration error related to the sheet 3'' is calculated using the registration errors of the preceding sheets, among others, also using the sheet 3'''.

Figure 5:
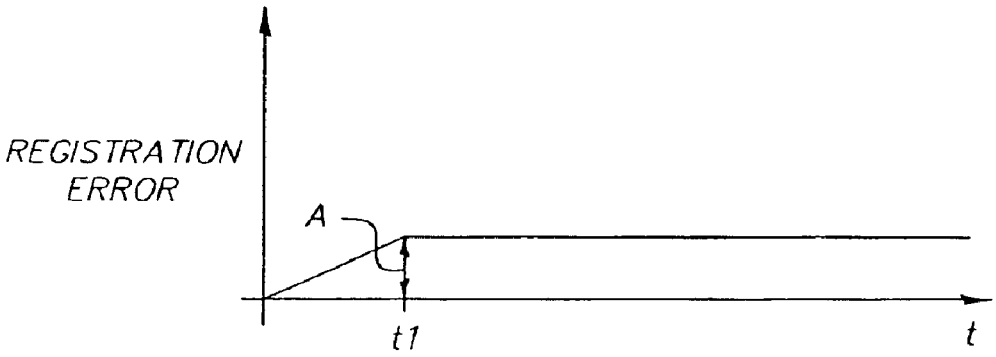
FIG. 5 shows a diagram of a registration error with the use of a control device according to an embodiment of the invention.

FIG. 5 shows a registration error when a control device 19 according to this invention is used. As becomes clear, the registration error grows from the beginning, time t=0, in linear course up to a registration error value of A and then remains approximately constant. The course of the registration error is represented in a linear progression; however, in reality it oscillates around the linear course. When the registration error assumes a constant value A, the control device 19 triggers the control process. The control process is stable and the registration error no longer grows as was the case in FIG. 4.

FIG. 6 shows a diagram similar to the one in FIG. 5 with a registration error as a function of time t. The course of the registration error is represented in a linear progression. However, in reality it oscillates around the linear course. The registration error grows from the beginning at t=0 until it reaches a registration error value A. Approximately at this time value of t1, when the registration error assumes a value of A, the control circuit 31, 32 is triggered. In case a PI controller is used in the control unit 6 instead of a proportional controller, the error A is corrected in the manner as shown in FIG. 6, so that the registration error equals approximately zero. In this manner, the registration error is correct approximately to a zero.

The invention has been described in detail with particular reference to certain preferred embodiments thereof, but it will be understood that variations and modifications can be effected within the spirit and scope of the invention.

What is claimed is:

1. Method for prevention of registration errors in a printing press, wherein a first sensor detects a sheet before a printing module and a second sensor detects the sheet after the printing module, characterized in that an actual number of pulses is counted between the detection of the sheet by the first sensor and by the second sensor, and is fed as the actual parameter into a closed-loop control system, the actual number of pulses is compared with a reference number of pulses, which represents a reference parameter of the closed-loop control system, a control signal of the closed-loop control system is determined from such comparison, and a controlled process of the closed-loop control system is provided with a number of pulses that is directly related to the current sheet to be printed in the printing module.

2. Method for prevention of registration errors according to claim 1, characterized in that in order to prevent a registration error, the point in time of the imaging of the printing drum is controlled.

3. Method according to claim 1, characterized in that the first sensor detects the front edge of the sheet and the second sensor detects a line on the sheet a the actual number of pulses is determined from these data.

4. Control device, with a first sensor for the detection of a sheet before a printing module and a second sensor for the detection of the sheet behind the printing module, comprising:

a closed-loop control system, providing a reference number of pulses stored in a device as a reference parameter of the closed-loop control system, and an actual number of pulses determined as an actual parameter of the closed-loop control system by detecting the sheet by the first sensor and by the second sensor, and the closed-loop control system includes a signal branch, through which a controlled process of the closed-loop control system can be fed a number of pulses, which is directly related to the sheet to be currently printed in the printing module.

5. Control device according to claim 4, characterized in that if a disturbance parameter exists that would result in a registration error, the point in time, at which the imaging of the receptor drum occurs, can be changed.

6. Control device according to claim 4, characterized in that the control parameter of the closed-loop control system is a signal that triggers the imaging of a line of an image.

7. Control device according to claim 4, characterized in that the control parameter of the closed-loop control system is a signal that triggers the imaging of a frame of an image.

8. Control device according to claim 4, characterized in that the signal branch, through which the controlled process of the closed-loop control system can be fed a number of pulses, includes an assessment component.

* * * * *